US005084081A

United States Patent [19]

Rohde

[11] Patent Number: 5,084,081

[45] Date of Patent: Jan. 28, 1992

[54] LOW TEMPERATURE AIR FRACTIONATION ACCOMMODATING VARIABLE OXYGEN DEMAND

[75] Inventor: Wilhelm Rohde, Munich, Fed. Rep. of Germany

[73] Assignee: Linde Aktiengesellschaft, Wiesbaden, Fed. Rep. of Germany

[21] Appl. No.: 512,241

[22] Filed: Apr. 20, 1990

[30] Foreign Application Priority Data

Apr. 27, 1989 [DE] Fed. Rep. of Germany ..... 3913880

[51] Int. Cl.[5] ..... F25J 3/04; F25J 3/02; F25J 1/02

[52] U.S. Cl. ..... 62/22; 62/24; 62/37; 62/40; 62/41

[58] Field of Search ..... 62/11, 24, 28, 37, 40, 62/41, 22, 27, 31

[56] References Cited

U.S. PATENT DOCUMENTS

| | | | |
|---|---|---|---|
| 3,056,268 | 10/1962 | Grenier . | |
| 3,174,293 | 3/1965 | Jakob et al. . | |
| 3,411,308 | 11/1968 | Bellinger | 62/37 X |
| 3,605,422 | 9/1971 | Pryor et al. | 62/37 X |
| 4,338,108 | 7/1982 | Isalski et al. | 62/40 X |
| 4,345,925 | 8/1982 | Cheung | 62/40 X |
| 4,526,595 | 7/1985 | McNeil | 62/28 |
| 4,529,425 | 7/1985 | McNeil | 62/37 |
| 4,604,116 | 8/1986 | Erickson | 62/28 X |
| 4,702,757 | 10/1987 | Kleinberg | 62/24 |
| 4,732,595 | 3/1988 | Yoshino | 62/11 |
| 4,747,860 | 5/1988 | Atkinson | 62/24 X |
| 4,780,118 | 10/1988 | Cheung | 62/11 |
| 4,790,866 | 12/1988 | Rathbone | 62/24 X |
| 4,818,262 | 4/1989 | Brugerolle | 62/41 X |
| 4,824,453 | 4/1989 | Rottmann et al. | 62/24 X |
| 4,853,015 | 8/1989 | Yoshino | 62/40 |
| 4,869,741 | 9/1989 | McGuinness et al. | 62/24 |

*Primary Examiner*—Henry A. Bennett
*Assistant Examiner*—Christopher Kilner
*Attorney, Agent, or Firm*—Millen, White & Zelano

[57] ABSTRACT

For the low temperature fractionation of air with variable oxygen production, compressed, prepurified, and cooled air (conduit 5) is initially fractionated in the high pressure stage 10 of a two-stage rectification 9. The thus-produced bottom liquid is further separated in the low pressure stage 11. Liquid nitrogen 14 from the high pressure stage 10 and liquid oxygen from the low pressure stage 11 can be stored intermediarily in tanks 35 and 32. An enriched liquid air tank 40 is additionally provided in order to store bottom liquid 12 from the high pressure stage 10. In case of increased oxygen production, the internal rate of flow in the high pressure stage 10 can be raised; and simultaneously the internal rate of flow in the low pressure stage 11 and the reflux ratios in both rectifying stages 10, 11 can be maintained constant. The constant reflux ratio in the low pressure column permits the argon bubble concentration to remain high, permitting a substantially maximum rate of separation of the argon in a crude argon column.

19 Claims, 1 Drawing Sheet

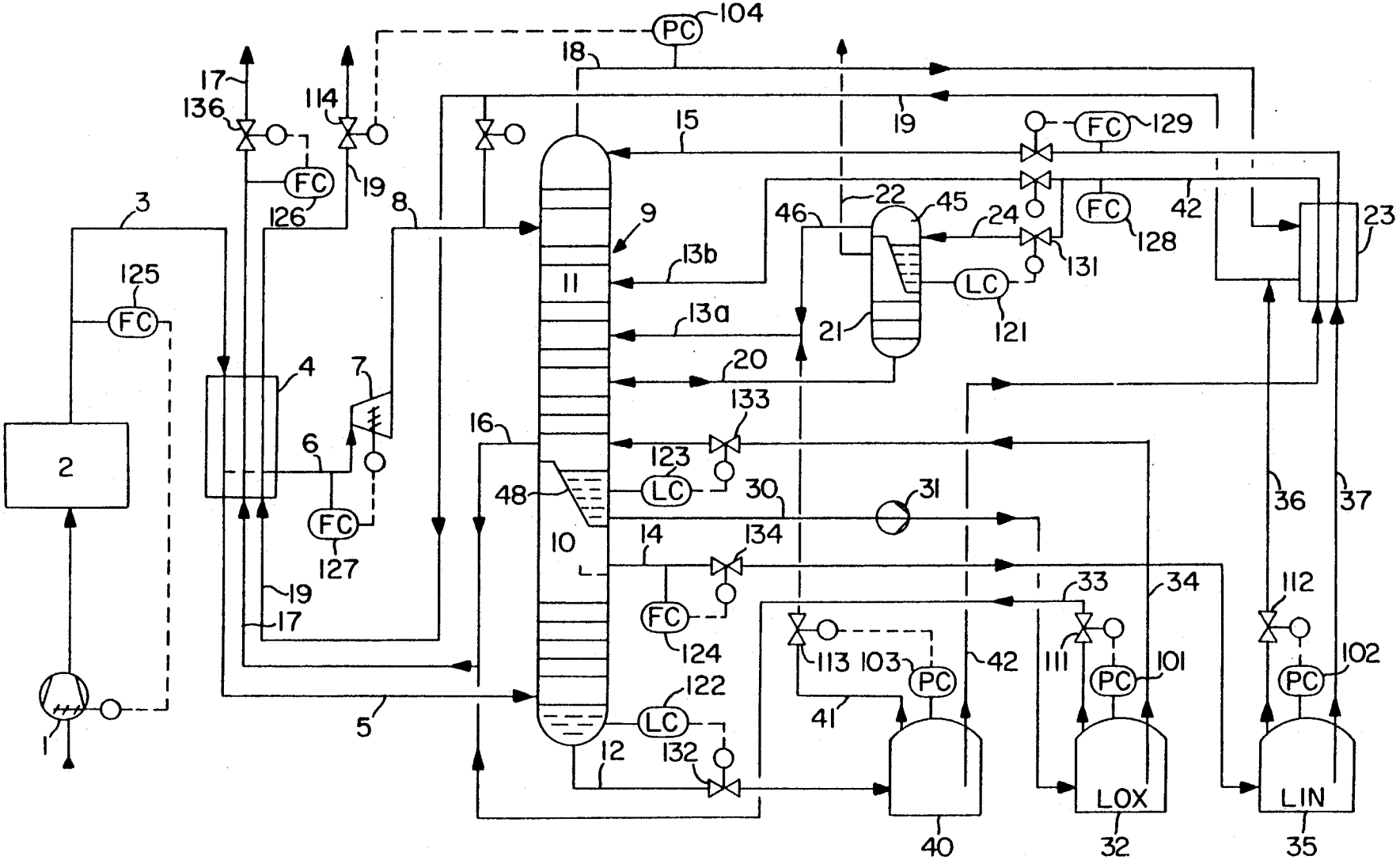
LIN
LOX
PC
FC
LC

LOW TEMPERATURE AIR FRACTIONATION ACCOMMODATING VARIABLE OXYGEN DEMAND

BACKGROUND OF THE INVENTION

This invention relates to a process and apparatus for the low temperature fractionation of air and, in particular, to a system which can accommodate a variable oxygen demand.

In various branches of industry, oxygen demand is subject to relatively large fluctuations in time intervals of minutes, hours, or days. From the standpoint of process control, the inertia of an industrial-scale, low temperature air fractionating column and associated apparatus is so high that it is uneconomical, in response to short-term demand changes, to manipulate the flow rate of the air feed which would result in an upset in the steady state design conditions of the column. Any such upset would also have deleterious effects on the efficiency of the separating process.

Conversely, it is just as disadvantageous to store excess oxygen in pressurized gas tanks and then withdraw such oxygen upon increased demand. Expensive, large pressurized gas tanks and additional compression energy would be necessary for this purpose.

For these reasons, a process has been developed for flexible oxygen production wherein fractionation products are withdrawn from the rectification column in the liquid phase and stored in liquid holding tanks. Such a process, with one tank each for oxygen and nitrogen, is known, for example, from Linde Reports on Science and Technology, No. 37/1984, pp. 18–20.

In the previously published process, liquid oxygen from the oxygen tank is fed into the bottom of the low pressure stage during the time period when a larger amount of gaseous oxygen is needed than can be produced by the column based on the amount of air introduced. This liquid oxygen is vaporized in the bottom of the low pressure stage in heat exchange with pressurized nitrogen at the head of the high pressure stage. Nitrogen is liquefied during the heat exchange, withdrawn from the high pressure stage, and stored in the nitrogen tank. During periods when excess gaseous oxygen is obtained, the stored liquid nitrogen becomes available as reflux for the low pressure column. This extra reflux thereby provides excess oxygen which is withdrawn in the liquid phase from the bottom of the low pressure column and stored in the oxygen tank.

In the conventional process with alternating storage by means of two liquid holding tanks, the amount of fractionated air remains constant at all times. In this method, a steady state operation of the rectification is obtained in the high pressure stage as well as in the low pressure stage.

In case of increased oxygen demand, it is necessary to have sufficient gaseous nitrogen available at the head of the high pressure stage so as to vaporize liquid oxygen in the bottom of the low pressure stage, permitting the withdrawal of such oxygen as a gaseous product. For this reason, under a normal load, a certain excess amount of gaseous high pressure nitrogen must be withdrawn in order to be able to maintain constant column separation rates. This amount of high pressure nitrogen removed during normal load operation is then available in case of increased oxygen demand for the vaporization of oxygen. However, this amount of nitrogen does not affect the rectification since during high load operation, both liquefied nitrogen from the head of the high pressure column and vaporizing oxygen at the bottom of the low pressure column are immediately withdrawn and do not participate in the mass transfer and heat transfer operations in the column. Thus, during high load operation, excess nitrogen is stored as liquid nitrogen in the nitrogen tank, while vaporized oxygen is withdrawn as the desired product.

During the period of high oxygen demand, the quantity of additional oxygen that can be withdrawn, i.e., the fluctuation range of the product quantity, is, in effect, determined by the amount of high pressure nitrogen removed in the gaseous phase during normal load. This portion of the nitrogen produced in the high pressure stage basically is not introduced into the low pressure stage but rather is removed from the process, either directly as a gaseous product (in the normal load case and in case of lowered oxygen demand) or through intermediate storage in the nitrogen tank (in case of increased oxygen demand). Therefore, independently of the load presently involved in the operation, this amount of nitrogen is not available as reflux for the low pressure column.

This lack of reflux has an adverse effect on the degree of rectification in the low pressure stage, which is especially deleterious if it is desired to produce a side stream of argon. For the latter purpose, a tap is made in the low pressure stage at a point of increased argon concentration, the so-called argon bulge. The extent of this argon bulge depends, however, greatly on the reflux ratio. The argon concentration at this point, and thus the possible argon yield as well, decrease if less than the entire amount of nitrogen produced in the high pressure stage is introduced in the liquid phase into the low pressure stage. For this reason, the rectifying relationships in the low pressure column and specifically the argon yield are unsatisfactory in the prior art process for variable oxygen production, and the severity of this product is increased as the fluctuation range of the oxygen product is increased.

SUMMARY OF THE INVENTION

It is thus an object of this invention to provide a process and associated apparatus permitting variable oxygen production with favorable product yields, especially when argon rectification is associated therewith.

Upon further study of the specification and appended claims, further objects and advantages of this invention will become apparent to those skilled in the art.

These objects are attained by providing a process comprising fractionating an amount of compressed air feed in a high pressure rectification stage into an oxygen-enriched liquid fraction and into a first nitrogen fraction, introducing the oxygen-enriched liquid fraction into a low pressure rectification stage which is in heat exchange relationship with the high pressure stage to further fractionate said oxygen-enriched liquid fraction into an oxygen fraction of increased purity and into a second nitrogen fraction, wherein:

in case of increased oxygen demand, withdrawing oxygen from an oxygen tank; and in case of lowered oxygen demand, passing liquid oxygen of increased purity from the low pressure stage to said oxygen tank;

in case of increased oxygen demand passing at least a portion of said oxygen-enriched liquid fraction into an enriched liquid air tank in order to store said oxygen-enriched liquid fraction; and in case of lowered oxygen demand, withdrawing at least a portion of the oxygen-enriched liquid from the enriched liquid air tank.

In other words, in case of increased oxygen demand, at least a portion of the oxygen-enriched liquid fraction from the bottom of the high pressure stage is introduced into a further storage tank (called herein an "enriched liquid air tank"), stored therein, and then withdrawn in case of lowered oxygen demand.

The intermediate storage of bottom liquid from the high pressure stage, in accordance with this invention, permits the reflux ratios in the high pressure and low pressure stages, as well as the interval rate of flow in the low pressure stage, to be maintained substantially constant. On the other hand, during a normal load period, the entire nitrogen produced in the high pressure stage can be withdrawn in the liquid phase and fed to the low pressure stage. Consequently, the optimum amount of reflux is available for the low pressure rectification, thereby yielding the maximum attainable argon concentration.

This is realized in accordance with the invention by vaporizing additionally needed oxygen in the low pressure stage by increasing the internal rate of flow in the high pressure stage. The resultant increased quantity of bottom liquid can be stored in the additional enriched liquid air tank and is available again, in case of lowered oxygen demand, to be fed into the low pressure column. The nitrogen additionally liquefied at the head of the high pressure column against vaporizing oxygen is discharged into a nitrogen tank, as in the previously known process.

For this process, it is advantageous, according to a further feature of the invention, to increase the amount of air supplied in case of increased oxygen demand. This brings about the desired increase in the internal rate of flow of the high pressure column and thus the vaporization of the liquid additionally introduced from the oxygen tank into the bottom of the low pressure column. Conversely, in case of lowered oxygen demand, the air supply is throttled, and liquid is withdrawn from the liquid air tank and from the nitrogen tank in order to keep the internal rate of flow in the low pressure column at a constant value. Due to the reduced rate of flow at the head of the high pressure stage, a smaller portion of the oxygen obtained in the low pressure column is vaporized. The corresponding amount is withdrawn in the liquid phase and stored in the oxygen tank.

The process of this invention is advantageously controlled so that fluctuations of the produced amount of oxygen do not substantially affect the reflux ratio, as well as the internal rate of flow in the low pressure stage, thereby permitting the reflux ratio and the internal rate of flow to remain substantially constant. The reflux ratio in the high pressure stage also remains substantially constant. By "substantially" is generally meant not more than a percentage deviation of 4%, preferably less than 2%.

In order to obtain argon, in addition to oxygen and nitrogen, an argon-containing oxygen fraction can be removed from the middle zone of the low pressure stage and separated in a crude argon rectification column into crude argon and into a residual fraction. This procedure permits, with the aid of the process of this invention, an especially high yield of argon and thus a highly economical operation.

The invention furthermore relates to an apparatus for performing the process described above, generally comprising a two-stage rectifying column having a high pressure column and a low pressure column with a joint condenser/evaporator; a nitrogen tank connected by nitrogen conduits with the high pressure and low pressure columns, and an oxygen tank connected by oxygen conduits with the low pressure column. The apparatus of this invention also comprises an enriched liquid air tank, a first conduit between the bottom of the high pressure column and the enriched liquid air tank, and a second conduit connecting the enriched liquid air tank and the low pressure column. (The expression "enriched liquid air" is used synonymously throughout for the oxygen-enriched fraction at the bottom of the high pressure stage.)

In order to control such a facility in accordance with the process of this invention, various parameters must be measured and controlled. It is advantageous for this purpose for the facility to include measuring units for the liquid level in the bottoms of the high pressure column and the low pressure column, a flowmeter in the nitrogen conduit between the high pressure column and the nitrogen tank, throttling means for controlling throughflow in the liquid air conduit, oxygen conduit, and nitrogen conduit, and regulating devices connected to the measuring units and controlling the throttling means.

BRIEF DESCRIPTION OF THE DRAWING

Various other objects, features, and attendant advantages of the present invention will become more fully appreciated as the same becomes better understood when considered in conjunction with the accompanying drawing, wherein:

The figure is a schematic flowsheet of a preferred comprehensive embodiment of the invention. Where the symbols FC, PC, and LC are employed, they designate conventional flow controllers, pressure controllers, and liquid level controllers. The various control valves associated with such controllers are identified by separate reference numbers.

DETAILED DESCRIPTION OF THE DRAWING

Air is taken in through an air compressor 1, then precooled and prepurified (2), and conducted via conduit 3 through a main heat exchanger 4, wherein the air is cooled countercurrently to product gases. Between 70–95%, preferably 88%, of the air is conducted to the cold end of the main heat exchanger 4 and fed via conduit 5 at a temperature of 95°–105° K. and under a pressure of 4–8 bar into the high pressure stage 10 of a two-stage rectification column 9.

The residual proportion of the air is discharged from the main heat exchanger 4 via conduit 6 at a temperature of 130°–190° K., expanded in an expansion turbine 7 to a pressure of 2.0–1.1 bar, and introduced via conduit 8 into the low pressure stage 11 of the rectification column 9.

In the high pressure stage 10, the air entering via conduit 5 is fractionated into liquid nitrogen collected at the top and into an oxygen-enriched bottoms liquid. Both fractions are withdrawn in the liquid phase, the nitrogen via conduit 14 and the bottoms liquid via conduit 12. The nitrogen is passed through control valve 134 and fed into a nitrogen storage tank 35 storing liquid nitrogen under a pressure of 1–6 bar. The liquid nitrogen is at least in part further subcooled in a heat exchanger 23 via conduit 37 and then introduced via conduit 15 to the head of the low pressure stage 11.

The oxygen-enriched bottoms liquid in conduit 12 is passed through control valve 132 and introduced into an enriched liquid air tank 40, wherein similar pressure conditions are ambient as in nitrogen tank 35.

Via conduit 42, liquid is withdrawn from enriched liquid air tank 40, cooled in heat exchanger 23, and introduced via conduit 13*b* into the low pressure stage 11. In the latter, the oxygen-enriched liquid from high pressure stage 10 is further fractionated.

As the primary product, gaseous oxygen is removed from the low pressure stage 11 above the liquid bottoms by way of conduit 16 and heated in main heat exchanger 4 to almost ambient temperature (conduit 19). Nitrogen obtained as the byproduct is withdrawn overhead by way of conduit 18, heated in heat exchanger 23 against the liquid fractions 37 and 42 obtained by way of the high pressure stage 10 and from the tanks 35, 40. The resultant heated nitrogen is conducted via conduit 19 through the main heat exchanger 4, where it is further heated to substantially ambient temperature.

By means of pump 31, liquid oxygen can be withdrawn via conduit 30 from the bottom of the low pressure stage 11 and introduced into an oxygen tank 32. In the reverse direction, via conduit 34, liquid can be fed from the oxygen tank 32 into the low pressure column 11.

At a point of relatively high argon concentration, e.g., 8% to 12% vol. % argon, the "argon-bulge", an argon-rich oxygen fraction is removed via conduit 20 from the low pressure stage 11, fed to a crude argon rectification column 21, and separated therein. Crude argon is withdrawn via conduit 22 from the head of the crude argon rectification column 21, and a liquid residual fraction is also withdrawn which is returned by way of conduit 20 into the low pressure stage 11.

The head of the crude argon rectification column 21 is cooled by liquid originating from the bottom of the high pressure column 10 and then from the enriched liquid air tank 40. For this purpose, a secondary conduit 24, including level controller 121 and control valve 131, is branched off from conduit 42 and is led into the head condenser 45 of the crude argon rectification 21. The oxygen-enriched air vaporized therein is withdrawn via conduit 46 and introduced into the low pressure stage 11 by way of conduit 13*a* at a point somewhat below the feed point for the oxygen-enriched liquid fraction in conduit 13*b* which stems from the bottom of the high pressure column.

The following description will explain how the above-described embodiment works when there is a switchover from normal load to increased oxygen production.

When the amount of oxygen removed by way of conduit 16 is to be increased, an increased rate of throughflow is set at the air compressor 1. The amount of flow is monitored by the flow controller 125 connected to the air compressor 1 (the conduit being shown in dashed lines in the drawing).

Throughflow via conduit 6 by way of the expansion turbine 7 to the low pressure stage 11 is kept substantially constant by regulating the flow through the expansion turbine 7 in accordance with the values indicated by the flow controller 127 (see the dashed line in the drawing).

The amount of air additionally taken in by the compressor 1 is thus practically completely introduced into the high pressure stage 10 and therein raises the internal rate of flow in the column. For example, in order to withdraw a quantity of gaseous product oxygen which is increased by 25%, the total amount of air must be increased by about 6.8%. By "internal rate of flow" is meant the amount per unit time of gas rising and liquid flowing down inside the rectification column. In general, this is proportional to the amounts separated per unit time at a constant concentration of components in each fractionated stream.

In correspondence with the additional amount of air, more liquid must be discharged via conduits 14 and 12. This procedure is regulated by flow controller 124 in conduit 14 and level controller 122 for the liquid level in the high pressure stage 10 in conjunction with the control valves 132, 134. Conversely, the amounts of liquid fed via conduits 15 and 13*b* to the low pressure stage are maintained constant by flow controllers 124 and 128. Excess liquid nitrogen and liquid oxygen-enriched air from the high pressure stage are stored in the nitrogen tank 35 and in the enriched liquid air tank 40, respectively.

The increased rate of flow in the high pressure stage 10, then, brings about an increased introduction of heat into the bottom of the low pressure stage 11 by way of the condenser/evaporator 48. The additionally vaporized oxygen can be withdrawn by way of conduit 16 as an increased amount of product. This procedure is controlled via the flow controller 126 and control valve 136 in conduit 17. In order to maintain rectification in the low pressure stage 11, an amount of liquid oxygen corresponding to the additionally withdrawn oxygen gas is removed from the oxygen tank 32 via conduit 34. The further supply of liquid oxygen is controlled by means of the liquid level controller 123 at the bottom of the low pressure stage 11 and by control valve 133.

If it is desired to produce less than the normal amount of oxygen, then the amount of air is reduced going into the high pressure stage 10. Additional liquid is fed into the low pressure stage from the nitrogen tank 35 and the enriched-liquid air tank 40, and oxygen is transferred in the liquid phase from the bottom of the low pressure stage 11 into the oxygen tank 32.

The pressure in the liquid tanks 32, 35, and 40 is monitored by means of pressure controllers 101, 102, 103. If necessary, gas is discharged from the tanks 32, 35, 40 by opening associated control valves 111, 112, and 113, respectively, namely, from the enriched liquid air tank 40 via conduits 41 and 13*a* into the low pressure stage; from the oxygen tank 32 via conduit 33 into the product conduit 17; and from the nitrogen tank 35 via conduit 36 into the product conduit 19.

In general, the oxygen-enriched liquid at the bottom of the high pressure stage has a concentration of oxygen of 32% to 40%, preferably 36% to 38% mol %, and the oxygen fraction at the bottom of the low pressure stage has a concentration of oxygen of 95% to 99.95% preferably 99.5% to 99.8 mol %. Likewise, the first nitrogen fraction at the head of the high pressure stage generally has a nitrogen concentration of 92% to 99,999%, preferably 99.5% to 99.99% mol %, and the second nitrogen fraction at the top of the low pressure stage generally has a concentration of 92% to 99,999%, preferably 99.5% to 99.99% molar percent nitrogen.

The entire disclosures of all applications, patents and publications, cited above, and of corresponding West German Application P 39 13 880.1, filed April 27, 1989, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A low temperature air fractionation process wherein a variable amount of oxygen is produced, comprising fractionating an amount of compressed air feed in a high pressure rectification stage into an oxygen-enriched liquid fraction and into a first nitrogen fraction; introducing the oxygen-enriched liquid fraction into a low pressure rectification stage which is in heat-exchange relationship with the high pressure stage to further fractionate said oxygen-enriched liquid fraction into an oxygen fraction of increased purity and into a second nitrogen fraction, wherein:

in case of increased oxygen demand, withdrawing oxygen from an oxygen tank; and in case of lowered oxygen demand, passing liquid oxygen of increased purity from the low pressure stage to said oxygen tank;

in case of increased oxygen demand passing at least a portion of said oxygen-enriched fraction into an enriched liquid air tank in order to store said oxygen-enriched liquid fraction; and in case of lowered oxygen demand, withdrawing at least a portion of the oxygen-enriched liquid from the enriched liquid air tank.

2. A process according to claim 1, further comprising increasing the amount of compressed air feed in response to an increased oxygen demand.

3. A process according to claim 1, wherein irrespective of fluctuations in the amount of oxygen produced, maintaining a reflux ratio as well as the internal rate of flow in the low pressure stage at a substantially constant value.

4. A process according to claim 2, wherein irrespective of fluctuations in the amount of oxygen produced, maintaining substantially constant a reflux ratio as well as an internal rate of flow in the low pressure stage.

5. A process according to claim 1, further comprising withdrawing an argon-containing oxygen fraction from a middle zone of the low low pressure stage and separating the argon-containing oxygen fraction in a crude argon rectification column into crude argon and into a residual fraction.

6. A process according to claim 2, further comprising withdrawing an argon-containing oxygen fraction from a middle zone of the low pressure stage and separating the argon-containing oxygen fraction in a crude argon rectification column into crude argon and into a residual fraction.

7. A process according to claim 3, further comprising withdrawing an argon-containing oxygen fraction from a middle zone of the low pressure stage and separating the argon-containing oxygen fraction in a crude argon rectification column into crude argon and into a residual fraction.

8. A process according to claim 4, further comprising withdrawing an argon-containing oxygen fraction from a middle zone of the low pressure stage and separating the argon-containing oxygen fraction in a crude argon rectification column into crude argon and into a residual fraction.

9. A process according to claim 1, further comprising during a period of increased oxygen demand, passing resultant withdrawn oxygen-enriched liquid air from the enriched liquid air tank to said low pressure stage.

10. A process according to claim 2, further comprising during a period of increased oxygen demand, passing resultant withdrawn oxygen-enriched liquid air from the enriched liquid air tank to said low pressure stage.

11. A process according to claim 3, further comprising during a period of increased oxygen demand, passing resultant withdrawn oxygen-enriched liquid air from the enriched liquid air tank to said low pressure stage.

12. A process according to claim 4, further comprising during a period of increased oxygen demand, passing resultant withdrawn oxygen-enriched liquid air from the enriched liquid air tank to said low pressure stage.

13. A process according to claim 5, further comprising during a period of increased oxygen demand, passing resultant withdrawn oxygen-enriched liquid air from the enriched liquid air tank to said low pressure stage.

14. A process according to claim 6, further comprising during a period of increased oxygen demand, passing resultant withdrawn oxygen-enriched liquid air from the enriched liquid air tank to said low pressure stage.

15. A process according to claim 7, further comprising during a period of increased oxygen demand, passing resultant withdrawn oxygen-enriched liquid air from the enriched liquid air tank to said low pressure stage.

16. A process according to claim 8, further comprising during a period of increased oxygen demand, passing resultant withdrawn oxygen-enriched liquid air from the enriched liquid air tank to said low pressure stage.

17. An apparatus for rectifying air at low temperatures into varying rates of oxygen production, comprising a two-stage rectifying column (9) having a high pressure column (10) and a low pressure column (11) and a joint condenser/evaporator (48); a nitrogen tank (35) connected by means of nitrogen conduits (14, 37, 15) with the high pressure and low pressure columns (10, 11); an oxygen tank (32) connected by means of oxygen conduits (30, 13*a*, 13*b*) with the low pressure column; and an enriched liquid air tank (40), a conduit (12) between the bottom of the high pressure column (10) and the enriched liquid air tank (4), and a further conduit (41, 13*a*; 42, 13*b*) connecting the enriched liquid air tank (40) and the low pressure column (11).

18. An apparatus according to claim 17, further comprising level controllers (122, 123) for the liquid level in the high pressure column and low pressure column bottoms, a flow controller (124) in the nitrogen conduit (14) between the high pressure column (10) and the nitrogen tank (35), and control valves (132, 133, 134) for controlling throughflow in the liquid air conduit (12), oxygen conduit (34), and nitrogen conduit (14), and means connecting to said controllers (122, 123, 124) for controlling the control valves (132, 133, 134).

19. An apparatus according to claim 17, further comprising a crude argon rectification column and conduit means communicating the crude argon rectification column with a middle zone of the low pressure column.

* * * * *